US010439286B2

(12) United States Patent
Kitahara

(10) Patent No.: US 10,439,286 B2
(45) Date of Patent: Oct. 8, 2019

(54) ANTENNA DEVICE

(71) Applicant: Tokyo Parts Industrial Co., Ltd., Gunma-ken (JP)

(72) Inventor: Takahisa Kitahara, Gunma-ken (JP)

(73) Assignee: Tokyo Parts Industrial Co., Ltd. (JP)

( * ) Notice: Subject to any disclaimer, the term of this patent is extended or adjusted under 35 U.S.C. 154(b) by 0 days.

(21) Appl. No.: 16/022,817

(22) Filed: Jun. 29, 2018

(65) Prior Publication Data

US 2019/0074589 A1 Mar. 7, 2019

(30) Foreign Application Priority Data

Sep. 7, 2017 (JP) ..... 2017-171701

(51) Int. Cl.
*H01Q 7/08* (2006.01)
*H01Q 1/42* (2006.01)
*H01Q 1/32* (2006.01)

(52) U.S. Cl.
CPC ..... *H01Q 7/08* (2013.01); *H01Q 1/3241* (2013.01); *H01Q 1/42* (2013.01)

(58) Field of Classification Search
CPC ..... H01Q 7/06–08; H01Q 1/3241
USPC ..... 343/788, 713
See application file for complete search history.

(56) References Cited

U.S. PATENT DOCUMENTS 7,095,381 B2 * 8/2006 Kimura ..... H01Q 1/3241 343/788
7,425,929 B2 * 9/2008 Sako ..... H01Q 7/08 343/787
2016/0315389 A1 * 10/2016 Imai ..... H01Q 1/52

FOREIGN PATENT DOCUMENTS

JP 2016-052035 A 4/2016
JP 2017-050809 A 3/2017

* cited by examiner

*Primary Examiner* — Dameon E Levi
*Assistant Examiner* — Hasan Z Islam
(74) *Attorney, Agent, or Firm* — Jordan and Koda, PLLC

(57) ABSTRACT

An antenna coil housed in a tubular case has a holder made from resin, which is fitted on a magnetic-material core. This holder has a core holding part, which holds the magnetic-material core, and a lead wire holding part, which holds lead wires. The lead wire holding part has first holding parts 22*a*, which hold the lead wires in the X direction, near the ends, and second holding parts 22*b*, which hold the ends of the lead wires in the Y direction, the ends of the coil being connected to conductors of the lead wires, which are led out via the second holding parts 22*b*.

10 Claims, 12 Drawing Sheets

ANTENNA DEVICE

BACKGROUND OF THE INVENTION

The present invention relates to an antenna device, which is, for example, installed in an internal space in a vehicle door handle, and can be used in a communication system with which doors are locked and unlocked by remote control, or the like.

In recent years, automobiles are often equipped with keyless entry systems, which lock and unlock doors without key operations. In keyless entry systems, the doors of a vehicle are locked and unlocked by remote control over short distances with an LF band (low frequencies of 30 to 300 kHz) communication system, in which an antenna device is installed in a door handle on the outside of the vehicle in order to communicate with a portable device, which is carried by the user of the vehicle.

For example, Japanese Patent Laid-Open Publication No. 2016-52035 discloses an antenna device in which an antenna is arranged in a tubular case. In this antenna device, a coil is wound around a magnetic-material core that is fixed in a holder, the two ends of the coil are connected to one of the ends of two metal terminals that are fixed on the holder, and two lead wires, which are connected to the other of the ends of the metal terminals, are lead out to the exterior of the case.

With the antenna device described in Japanese Patent Laid-Open Publication No. 2016-52035, even if the lead wires were to be pulled, the tensile force would be prevented from acting directly on the coil, such that disconnection of the coil can be prevented, and thus the durability and reliability were excellent.

However, in the antenna device described in Japanese Patent Laid-Open Publication No. 2016-52035, the two ends of the coil and the two lead wires must each be electrically connected to the two metal terminals, such that there are problems in terms of increased material costs and manufacturing costs.

SUMMARY OF THE INVENTION

One or more embodiments of the present invention provide an antenna device capable of overcoming the aforementioned problems in the prior art while maintaining durability and reliability.

Note that, in the aspects described below, the constituent elements employed can be used in the most freely chosen combinations possible. Furthermore, the aspects and technical features of the present invention are not limited to those described hereafter, and are to be understood based on the description in the entire specification and the drawings, or based on the inventive ideas that can be grasped by the skilled artisan based on these descriptions.

A first aspect of the present invention is an antenna device in which an antenna coil is housed in a tubular case, wherein:

the antenna coil has a rectangular parallelepiped magnetic-material core elongated in the X direction, a holder made from resin, which is fitted on the magnetic-material core, a coil, which is wound around the outer periphery of the magnetic-material core, and two lead wires, which are electrically connected to the two ends of the coil and are led out to the exterior of the case;

the holder has a core holding part, which holds the magnetic-material core and a lead wire holding part that holds the lead wires;

the lead wires have a conductor and an insulating covering, which covers the conductor;

the lead wire holding part has first holding parts, which hold the lead wires in the X direction, near the ends, and second holding parts, which hold the ends of the lead wires in the Y direction; and the ends of the coil are directly connected to the conductors, which are led out via the second holding parts.

A second aspect of the present invention is an antenna device in which an antenna coil is housed in a tubular case, wherein:

the antenna coil has a rectangular parallelepiped magnetic-material core elongated in the X direction, a holder made from resin, which is fitted on the magnetic-material core, a coil, which is wound around the outer periphery of the magnetic-material core, and two lead wires, which are electrically connected to the two ends of the coil and are led out to the exterior of the case;

the holder has a core holding part, which holds the magnetic-material core and a lead wire holding part that holds the lead wires;

the lead wires have a conductor and an insulating covering, which covers the conductor;

the lead wire holding part has first holding parts, which hold the lead wires in the X direction, near the ends, and second holding parts, which hold the ends of the lead wires in the Y direction; and the ends of the coil are directly connected to the conductors, which are led out via the second holding parts;

the second holding parts have a through-hole;

the inner diameter of the through-hole is greater than the outer diameter of the conductor and less than the outer diameter of the insulating covering;

the conductor is led out via the through-hole; and the leading end face of the insulating covering is positioned on the proximal side of the through-hole; and the two second holding parts, which hold the two lead wires, are provided at different positions in the X direction.

A third aspect of the present invention is an antenna device in which an antenna coil is housed in a tubular case, wherein:

the antenna coil has a rectangular parallelepiped magnetic-material core elongated in the X direction, a holder made from resin, which is fitted on the magnetic-material core, a coil, which is wound around the outer periphery of the magnetic-material core, and two lead wires, which are electrically connected to the two ends of the coil and are led out to the exterior of the case;

the holder has a core holding part, which holds the magnetic-material core and a lead wire holding part that holds the lead wires;

the lead wires have a conductor and an insulating covering, which covers the conductor;

the lead wire holding part has first holding parts, which hold the lead wires in the X direction, near the ends, and second holding parts, which hold the ends of the lead wires in the Y direction; and the ends of the coil are directly connected to the conductors, which are led out via the second holding parts;

the second holding parts have a lead-out groove, which leads the conductor out, and a stepped part adjacent to the lead-out groove;

the leading end of the insulating covering is positioned by way of the stepped part; and the two second holding parts, which hold the two lead wires, are provided at different positions in the X direction.

With to the antenna device of the present invention, the lead wires can be reliably held by the first holding part and the second holding part, which are provided substantially orthogonal to each other in the lead wire holding part of the holder, and even if the lead wire is pulled, the tensile force can be effectively prevented from acting on the coil. In addition, because the two ends of the coil are directly connected to the conductors of the lead wires, which are led out via the second holding parts, the two metal terminals in the prior art can be dispensed with. Accordingly, it is possible to limit the material costs and the manufacturing costs of the antenna device while maintaining durability and reliability.

DETAILED DESCRIPTION OF THE PREFERRED EMBODIMENTS

First Exemplary Mode of Embodiment

Figure 1A:
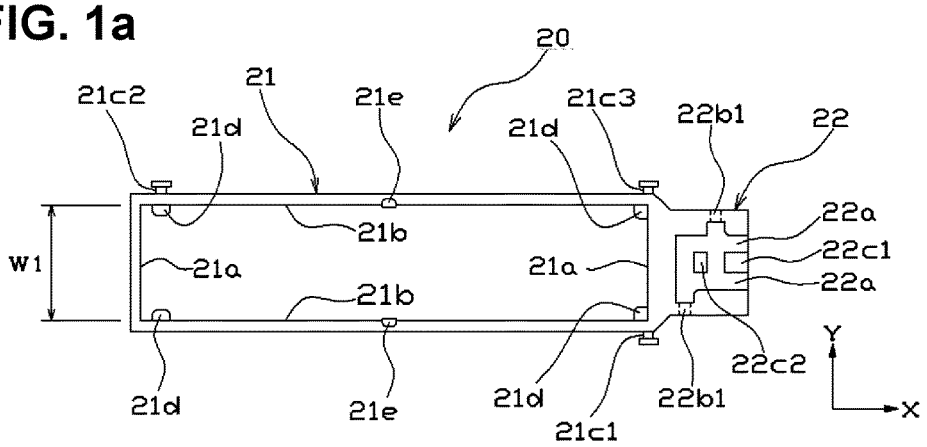
FIG. 1 shows a holder according to a first exemplary mode of embodiment of the present invention, wherein (a) is a top view, (b) is a bottom view, and (c) is a side view.
Figure 1B:
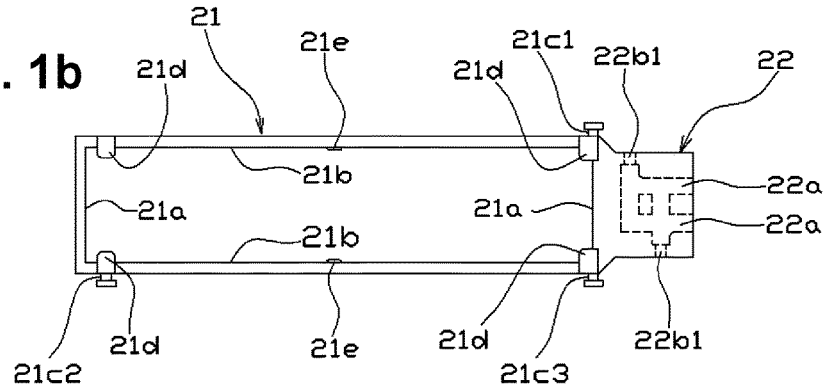
Figure 1C:
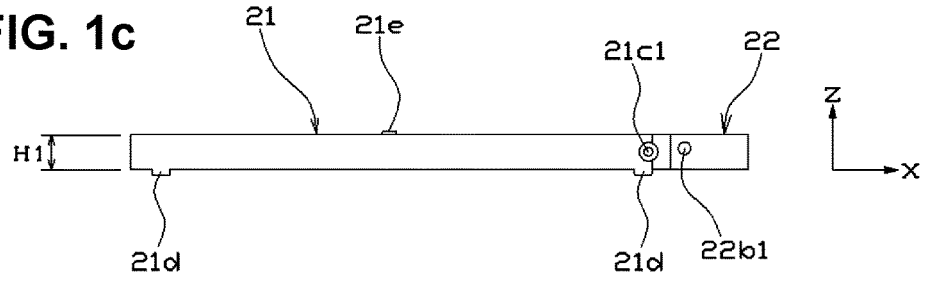
Figure 2A:
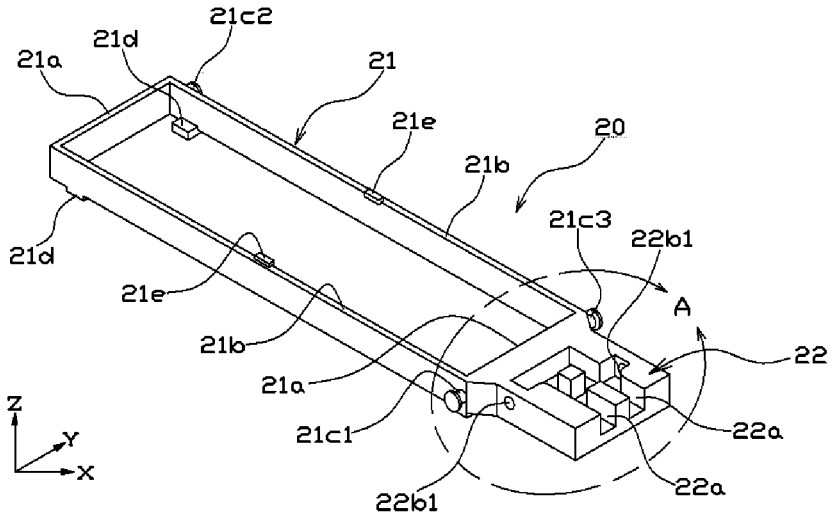
FIG. 2 is a perspective view of the holder in FIG. 1, wherein (a) is an overall perspective view, and (b) is an enlarged perspective view of a portion A in (a).
Figure 2B:
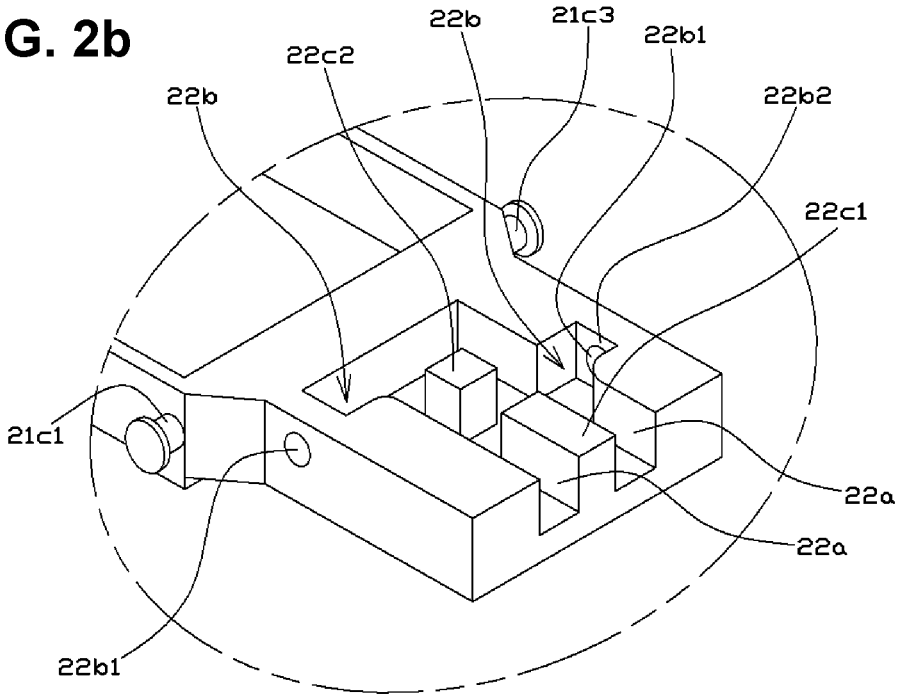
Figure 3A:
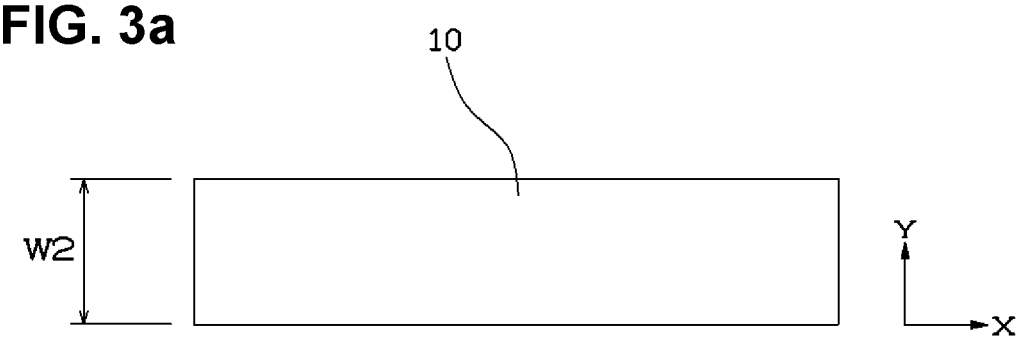
FIG. 3 shows a magnetic-material core according to a first exemplary mode of embodiment of the present invention, wherein (a) is a top view and (b) is a side view.
Figure 3B:
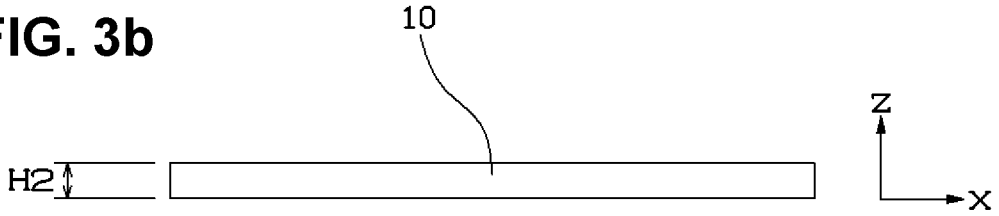
Figure 4:
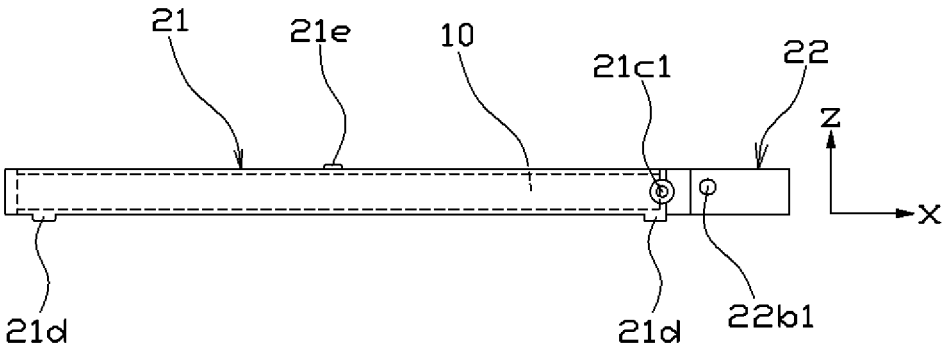
FIG. 4 is a side view showing the situation in which the magnetic-material core in FIG. 3 is fitted in the holder of FIG. 1.

An antenna device 1 according to a first exemplary mode of embodiment of the present invention will be described with reference to FIG. 1 to FIG. 6. The antenna device 1 of the present example is one in which an antenna coil 3 is housed in a case 2, and is installed inside a door handle of a vehicle that is equipped, for example, with a keyless entry system, and which can be used as part of a communication system in which doors are locked and unlocked by remote control.

The antenna coil 3 in present example principally comprises a magnetic-material core 10, a holder 20, a coil 30 and lead wires 40, and does not use the metal terminals found in the prior art antenna device.

The magnetic-material core 10 has a flat rectangular parallelepiped shape, elongated in the X direction (left/right direction in FIG. 3), in which the width W2 in the Y direction is greater than the height H2 in the Z direction. There are no particular limitations on the material for the magnetic-material core 10 as long as this has the desired magnetic characteristics, and any magnetic material such as a metal magnetic-material, a Ni—Zn ferrite, a Mn—Zn ferrite or the like can be used.

The holder 20 is made from integrally molded insulating resin, and is provided with a core holding part 21, which holds the magnetic-material core 10 and a lead wire holding part 22 that holds the lead wires 40.

The core holding part 21 has first covering parts 21*a*, which cover two sides of the magnetic-material core 10 that face each other in the X direction, and second covering parts 21*b*, which cover two sides of the magnetic-material core 10 that face each other in the Y direction. The core holding part 21 is open in Z direction, and by slightly elastically deforming the second covering parts 21*b*, the magnetic-material core 10 can be fitted, via the open portion, into the internal space that is surrounded by the first covering parts 21*a* and the second covering parts 21*b*. The Y direction width W1 of the internal space of the core holding part 21 is configured to be the same as the width W2 of the magnetic-material core 10. Meanwhile, the height H1 in the Z direction of the internal space of the core holding part 21 is configured to be slightly greater than the height H2 of the magnetic-material core 10, such that the two end faces of the core holding part 21 in the Z direction protrude slightly beyond the two end faces of the magnetic-material core 10 in the Z direction.

Restraining projections 21*d*, 21*e*, which restrain the movement, in the Z direction, of the magnetic-material core 10, which is fitted on the core holding part 21, are provided at predetermined positions on the first covering parts 21*a* and the second covering parts 21*b*. Specifically, four restraining projections 21*d*, which protrude slightly toward the internal space side from the bottom of the core holding part 21, and two restraining projections 21*e*, which protrude slightly toward the internal space side from the top of the core holding part 21 are provided. The distance in the Z direction from the top of the restraining projections 21*d* to the bottom of the restraining projections 21*e* is configured to be equal to the height H2 of the magnetic-material core 10.

On the outer surfaces of the second covering parts 21*b*, three binding parts are provided, on which the coil 30 is bound. Specifically, on one second covering part 21*b*, a binding part 21*c*1 is provided only in a portion close to the lead wire holding part 22, while on the other second covering part 21*b*, a binding part 21*c*2 and a binding part 21*c*3 are respectively provided in a portion distant from the lead wire holding part 22 and in a portion close to the lead wire holding part 22. These binding parts protrude in the Y direction from the outer surfaces of the second covering parts 21*b*, the tips being formed so as to expand in a flange shape.

The lead wire holding part 22 is a portion extending in the X direction from one first covering part 21*a* of the core holding part 21. The lead wire holding part 22 has two first holding parts 22*a* which hold the two lead wires 40 in the X direction, near the ends, and two second holding parts 22*b* which hold the ends of the two lead wires 40 in the Y direction.

The first holding parts 22*a* take the form of rectangular grooves, the width of these grooves, in the Y direction, being configured so as to be slightly less than the outer diameter of the lead wires 40 (that is to say, the outer diameter of an insulating covering 42). Furthermore, the depth of the grooves in the Z direction is configured so as to be slightly greater than the outer diameter of the lead wires 40. The two first holding parts 22*a* are provided at different positions in the Y direction, and a first partition wall 22*c*1 and a second partition wall 22*c*2 are provided between the two first holding parts 22*a*. This groove between the first partition wall 22*c*1 and the second partition wall 22*c*2 can be utilized in holding the lead wires 40.

The two second holding parts 22*b* are provided at different positions in the X direction. Through-holes 22*b*1 are provided at the ends of these second holding parts 22*b*, the remaining portions thereof being rectangular grooves similar to the first holding parts 22*a*. The inner diameter of the through-holes 22*b*1 is configured so as to be slightly greater than the outer diameter of the conductor 41 of the lead wire 40 and less than the outer diameter of the lead wire 40, a proximal wall 22*b*2 being formed at the boundary between the through-hole 22*b*1 and the rectangular groove. The inner peripheral side of the intersection between the first holding part 22*a* and the second holding part 22*b* constitutes an arcuately curved rectangular groove.

The coil 30 is made of a single conductor covered with a heat-resistant resin such as polyimide, and is wound around the outer periphery of the magnetic-material core 10, which is fitted in the core holding part 21. Specifically, after binding the coil end 31*a* at the winding start end onto the binding part 21*c*1, the coil is wound around the outer periphery of the second covering part 21*b* of the core holding part 21, and then, after binding this to the binding part 21*c*2, lastly, the coil end 31*b* at the winding finish end is bound to the binding part 21*c*3.

Both Z-direction end faces of the core holding part 21 protrude slightly beyond both Z-direction end faces of the magnetic-material core 10, such that a slight gap is present in the Z direction, between the coil 30 that has been wound around the outer periphery of the second covering part 21*b* and the magnetic-material core 10. Therefore, even if, for example, Mn—Zn ferrite, which has low resistivity, is used as the magnetic-material core 10, isolation can be maintained between the magnetic-material core 10 and the coil 30.

The two lead wires 40 comprise a conductor 41 at the center part and an insulating covering 42, which covers this conductor 41, the leading end of which is stripped so as to expose a predetermined length of the conductor 41.

The ends of the lead wires 40 are pushed into the second holding parts 22*b* and the portions near the ends of the lead wires 40 are pushed into the first holding parts 22*a*, whereby the two lead wires 40 are held by the lead wire holding part 22. Specifically, the insulating coverings 42 of the lead wires 40 are held in the grooves of the first holding part 22*a* and the second holding part 22*b* in a slightly compressed state.

Furthermore, the conductors 41 at the leading ends of the two lead wires 40 are each led out in the Y direction of the lead wire holding part 22 through the through-holes 22*b*1 in the two second holding parts 22*b*, and the leading end faces 42*a* of the insulating coverings of the two lead wires 40 are positioned by abutting the proximal walls 22*b*2 of the through-holes 22*b*1.

The coil ends 31*a* and 31*b* are each directly electrically connected to the conductors 41 of the two lead wires 40, which are lead out via the two through-holes 22*b*1. There are no particular limitations on the method of connecting the conductors and the coil ends and, in addition to solder connections, this can also be performed by way of Nd:YAG welding, for example.

Figure 5:
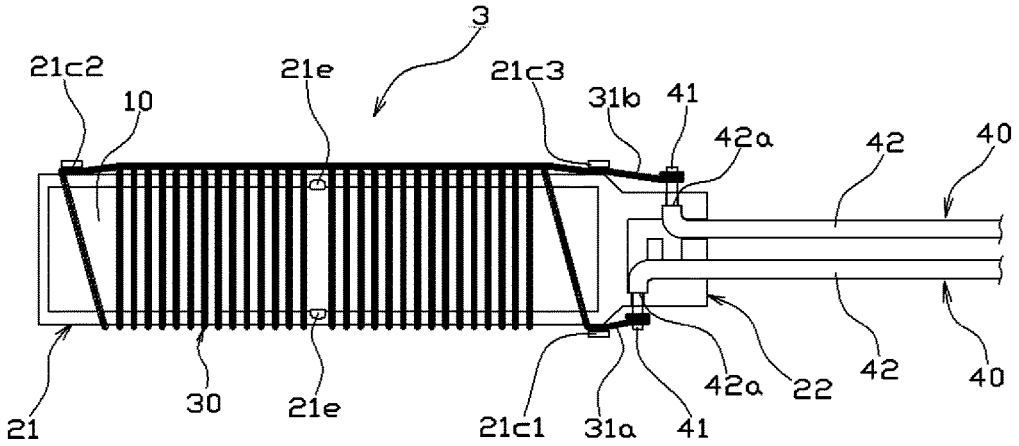
FIG. 5 is a top view of the antenna coil according to the first exemplary mode of embodiment of the present invention.
Figure 6:
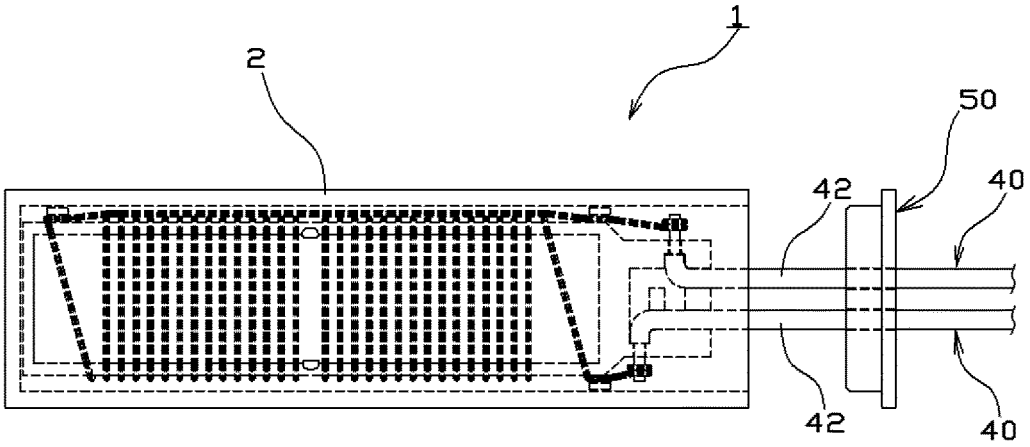
FIG. 6 is a top view illustrating the antenna device according to the first exemplary mode of embodiment of the present invention.

The antenna coil 3 in FIG. 5, which is configured in this manner, is inserted into a bottomed tubular case 2, which is made from an insulating resin, as shown in FIG. 6. At this time, one of the first covering parts 21*a* and the three binding parts 21*c*1, 21*c*2, and 21*c*3 are brought into contact with the inner walls of the case 2 so as to position the antenna coil 3 and, if necessary, the space remaining in the case 2 is filled with a filler made from a soft resin. Furthermore, the opening end of the case 2 is closed by a closing member 50 that is made from an insulating resin and the two lead wires 40 are led out to the exterior via the two holes provided in the closing member 50, whereby the antenna device 1 is completed.

The antenna device 1 of the present example, which is described above, is such that the ends of the lead wires 40 are held in the lead wire holding part 22 of the holder 20, in a compressed state, by the first holding parts 22*a* and the second holding parts 22*b*, which are provided so as to be orthogonal to each other. Therefore, even if the lead wire 40 is pulled from the direction of extension of the lead wires 40 (the X direction), the tensile force thereof can be effectively prevented from acting on the parts where the coil 30 and the conductor 41 are connected. Furthermore, since the ends of the coil 30 are directly connected to the conductors 41, which have been led out via the second holding parts 22*b*, the two metal terminals in the prior art can be dispensed with. Accordingly, it is possible to limit the material costs and the manufacturing costs of the antenna device while maintaining durability and reliability.

Furthermore, in the antenna device 1 of the present example, the inner diameter of the through-hole 22*b*1, which is provided in the second holding part 22*b*, is configured so as to be greater than the outer diameter of the conductor 41 of the lead wire 40 and less than the outer diameter of the insulating covering 42. Further, the conductor 41 is led out to the exterior through the through-hole 22*b*1, and the leading end face 42*a* of the insulating covering 42 is positioned by abutting against the proximal wall 22*b*2 on the proximal side of the through-hole 22*b*1. Therefore, the amount of lead-out (the length that is led out) of the conductor 41 that is connected to the coil end can be suitably managed, and connections with the coil ends can be easily and uniformly formed, such that a higher quality antenna device can be manufactured with good reproducibility.

Furthermore, in the antenna device 1 of the present example, the two second holding parts 22*b*, which hold the two lead wires 40 are provided at different positions in the X direction. Therefore, the two lead wires 40 can each easily be passed through the respective through-holes 22*b*1 in the second holding part 22*b*, such that the antenna device can easily be manufactured.

Furthermore, in the antenna device 1 of the present example, the core holding part 21 of the holder 20 has first covering parts 21*a*, which cover the two sides of the magnetic-material core 10 that face each other in the X direction, and second covering parts 21*b*, which cover two sides of the magnetic-material core 10 that face each other in the Y direction, and the core holding part 21 is open in the Z direction. Consequently, it is possible to limit the height of the antenna coil 3 in the Z direction, and thus limit the thickness of the overall antenna device, such that this will be suitable for mounting in a door handle having a constrained internal space.

Second Exemplary Mode of Embodiment

Figure 7A:
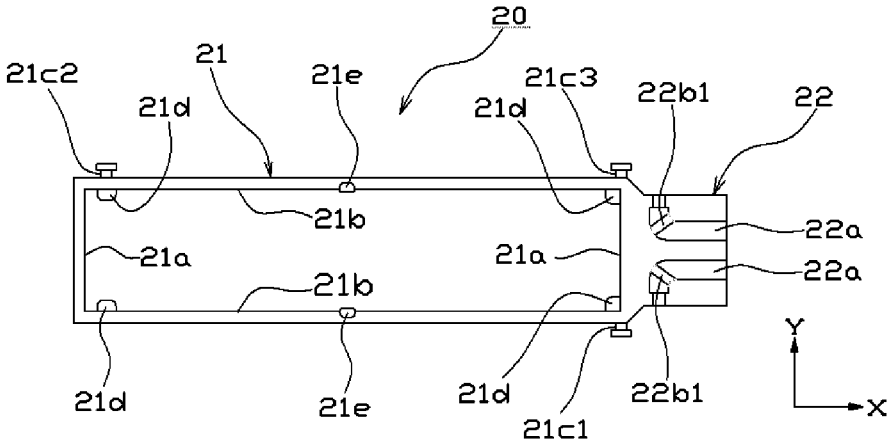
FIG. 7 shows a holder according to a second exemplary mode of embodiment of the present invention, wherein (a) is a top view, (b) is a bottom view, and (c) is a side view.
Figure 7B:
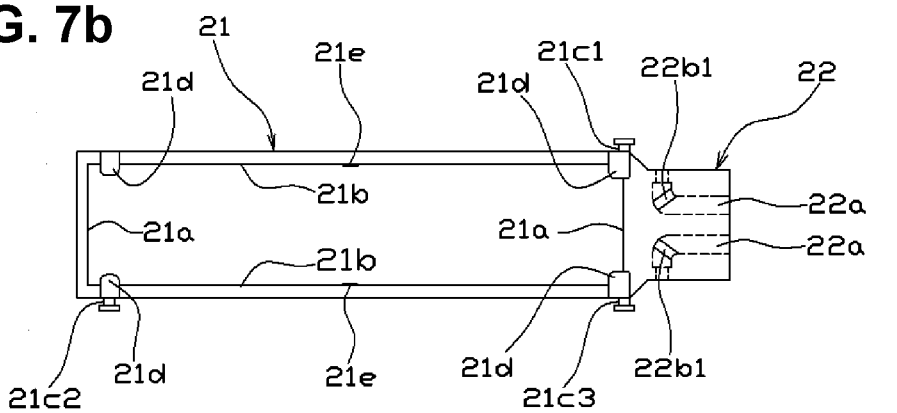
Figure 7C:
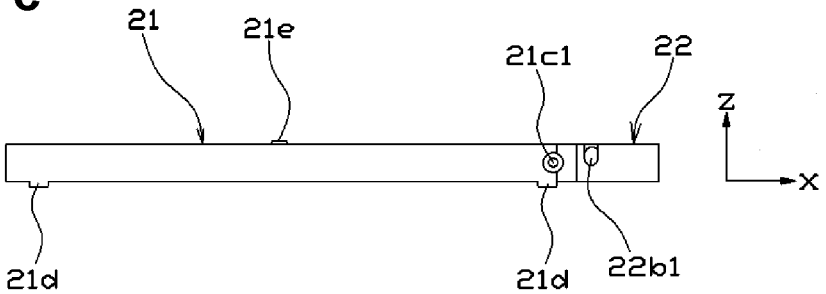
Figure 8A:
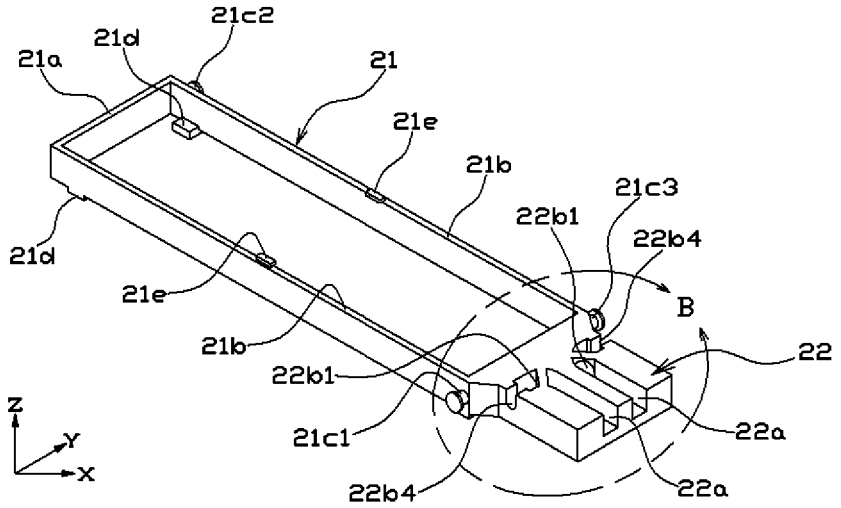
FIG. 8 is a perspective view of the holder in FIG. 7, wherein (a) is an overall perspective view, and (b) is an enlarged perspective view of a portion B in (a).
Figure 8B:
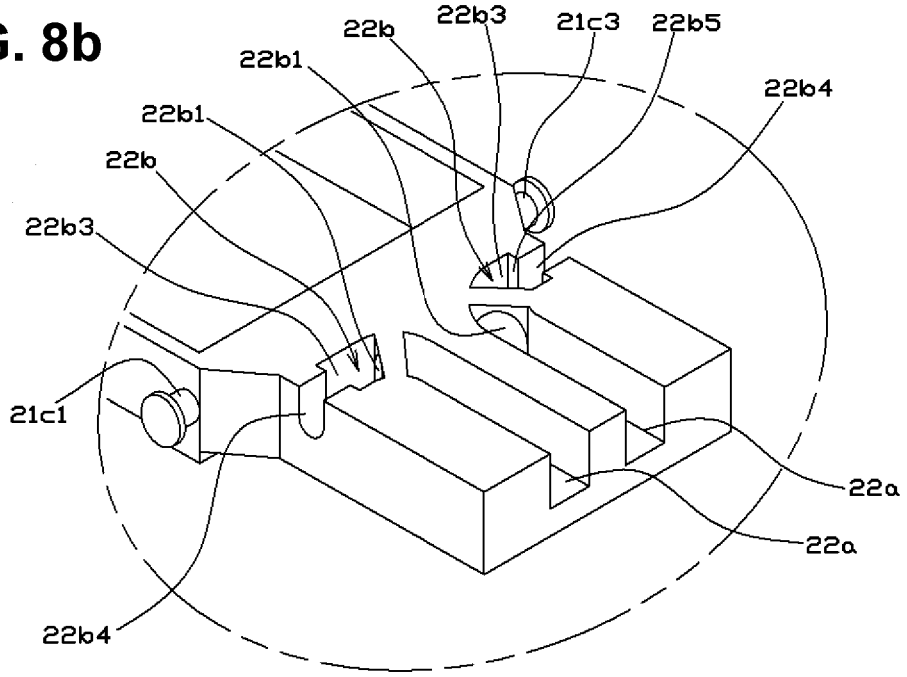
Figure 9:
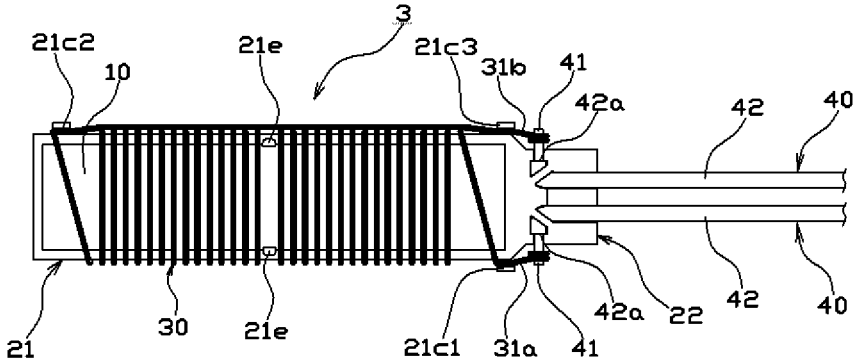
FIG. 9 is a top view of an antenna coil according to a second exemplary mode of embodiment of the present invention.

A second exemplary mode of embodiment of the present invention will be described with reference to FIG. 7 to FIG. 9. In FIG. 7 to FIG. 9, the same reference numerals as those in FIG. 1 to FIG. 6 indicate the same constituent elements, and redundant descriptions are omitted.

In the present exemplary mode of embodiment, only the structures of the lead wire holding part 22 of the holder 20 differ from those in the first exemplary mode of embodiment. Specifically, the lead wire holding part 22 in the first exemplary mode of embodiment had a structure in which only the conductor 41 of the lead wire passes through the through-hole 22*b*1, but the lead wire holding part 22 in the present exemplary mode of embodiment has a structure in which the entire lead wire (the conductor 41 and the insulating covering 42) passes through a through-hole 22*b*1.

In the same manner as in the first exemplary mode of embodiment, the lead wire holding part 22 in the present example is provided with two first holding parts 22*a*, which hold the two lead wires 40 in the X direction, near the ends, and two second holding parts 22*b*, which hold the ends of the two lead wires 40 in the Y direction.

The first holding parts 22*a* take the form of rectangular grooves, the width of these grooves, in the Y direction, being configured so as to be slightly less than the outer diameter of the lead wires 40. Furthermore, the depth of the grooves in the Z direction is configured so as to be slightly greater than the outer diameter of the lead wires 40.

The second holding part 22*b* has through-holes 22*b*1, which are provided adjacent to the first holding part 22*a*, guide grooves 22*b*3 which are arranged at the ends of the through-holes 22*b*1, and laterally opening lead-out grooves 22*b*4, which are arranged at the ends of the guide grooves 22*b*3. The inner diameter of the through-hole 22*b*1 and the width of the guide groove 22*b*3 in the X direction are approximately the same as the outer diameter of the lead wire 40 (that is to say, the outer diameter of the insulating covering 42), and the width of the lead-out groove 22*b*4 in the X-direction is approximately the same as the outer diameter of the conductor 41 of the lead wire 40. Accordingly, a stepped part 22*b*5 is formed between the guide groove 22*b*3 and the lead-out groove 22*b*4. The inner peripheral side and the outer peripheral side of the intersection between the first holding part 22*a* and the second holding part 22*b* are arcuately curved and the through-hole 22*b*1 is provided in the curved portion.

The end of the lead wire 40 is pushed into the through-hole 22*b*1 and the guide groove 22*b*3 of the second holding part 22*b* and the portion near the end of the lead wire 40 is pushed into the first holding part 22*a* such that the two lead wires 40 are held by the lead wire holding parts 22. Furthermore, the leading end faces 42*a* of the insulating covering of the two lead wires 40 which are led out through the through-holes 22*b*1 to the guide grooves 22*b*3 are positioned by abutting against the stepped parts 22*b*5. Furthermore, the conductors 41 at the leading ends of the two lead wires 40 are each respectively led out in the Y direction of the lead wire holding part 22 through the two lead-out grooves 22*b*4.

With the present example, an effect similar to that in the first exemplary mode of embodiment is produced. In addition, in the antenna device of the present example, since the lead wire holding part 22 has a structure in which the entire lead wire passes through the through-hole 22*b*1, tensile force applied to the lead wire 40 can be more effectively prevented from acting on the part where the coil 30 and the conductor 41 are connected and thus an antenna device having higher durability and reliability can be manufactured.

Third Exemplary Mode of Embodiment

Figure 10A:
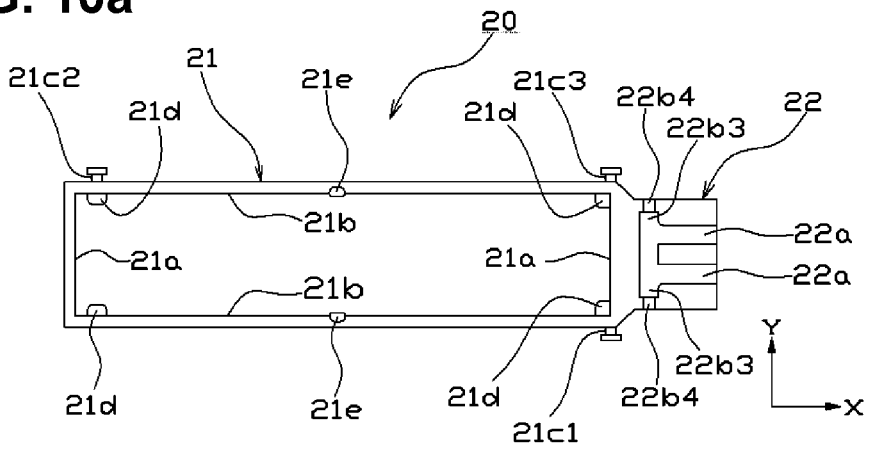
FIG. 10 shows a holder according to a third exemplary mode of embodiment of the present invention, wherein (a) is a top view, (b) is a bottom view, and (c) is a side view.
Figure 10B:
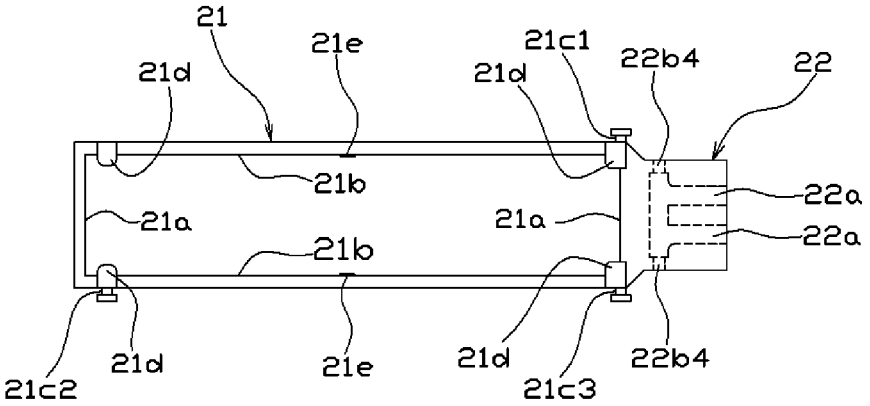
Figure 10C:
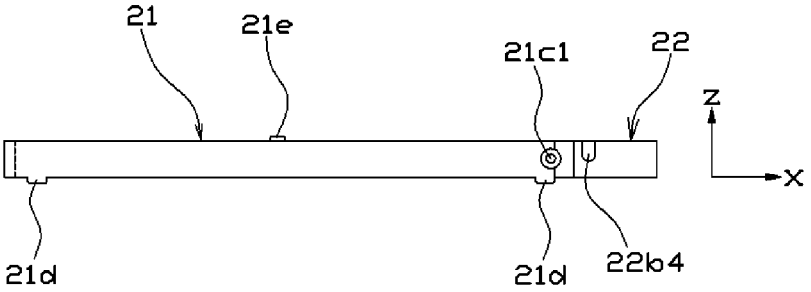
Figure 11A:
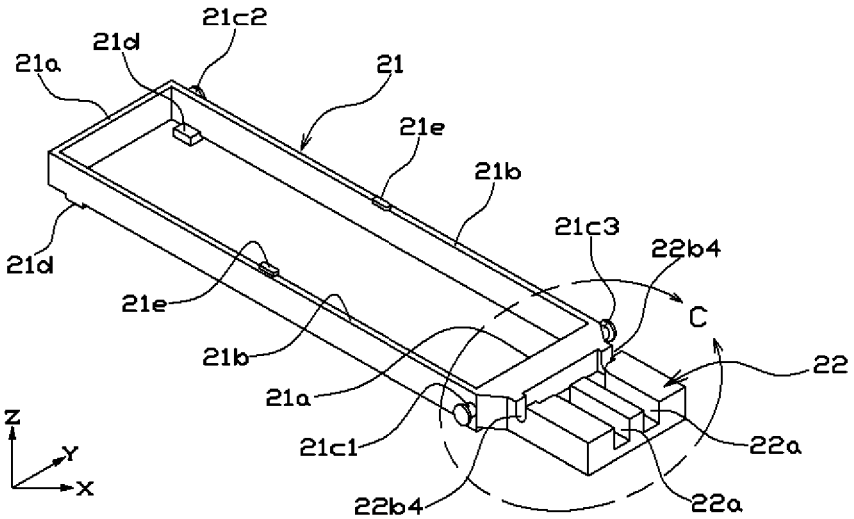
FIG. 11 is a perspective view of the holder in FIG. 10, wherein (a) is an overall perspective view, and (b) is an enlarged perspective view of a portion C in (a).
Figure 11B:
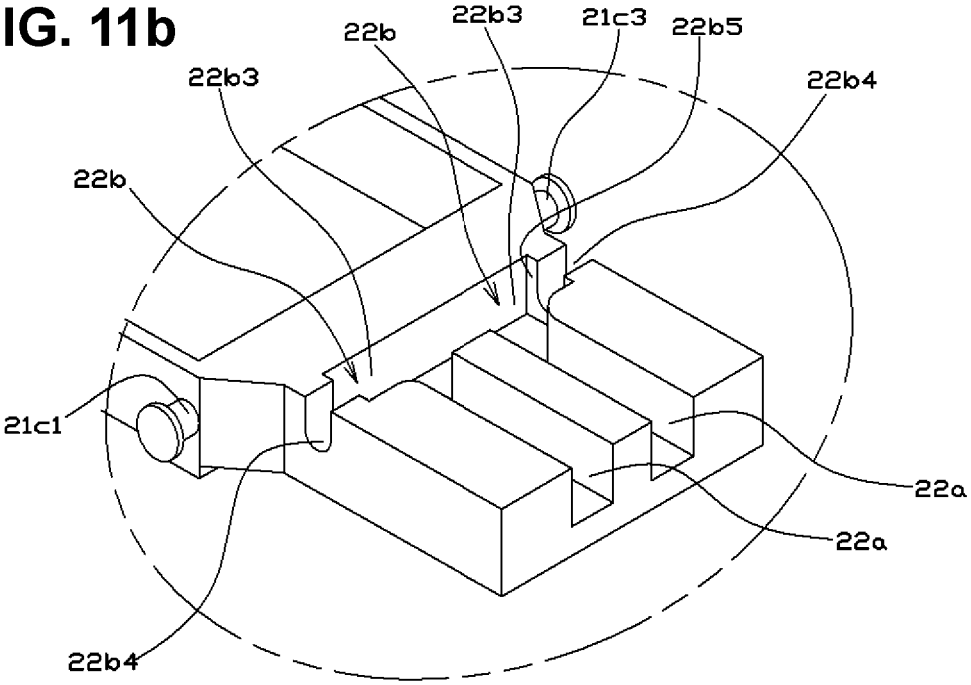
Figure 12:
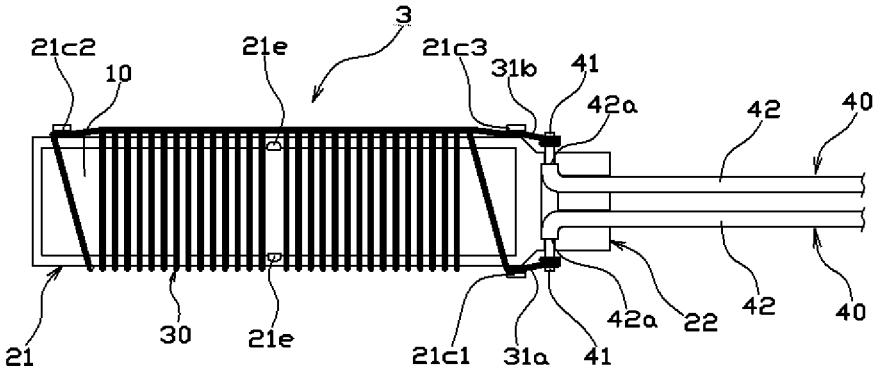
FIG. 12 is a top view of the antenna coil according to a third exemplary mode of embodiment of the present invention.

A third exemplary mode of embodiment of the present invention will be described with reference to FIG. 10 to FIG. 12. In FIG. 10 to FIG. 12, the same reference numerals as those in FIG. 1 to FIG. 6 indicate the same constituent elements, and redundant descriptions are omitted.

In the present exemplary mode of embodiment, only the structures of the lead wire holding part 22 of the holder 20 differ from those in the first exemplary mode of embodiment and the second exemplary mode embodiment. Specifically, the lead wire holding part 22 in the first exemplary mode of embodiment and the second exemplary mode of embodiment have a through-hole 22*b*1, but the lead wire holding part 22 in the present exemplary mode of embodiment consists only of grooves.

In the same manner as in the first exemplary mode of embodiment, the lead wire holding part 22 in the present example is provided with two first holding parts 22*a*, which hold the two lead wires 40 in the X direction, near the ends, and two second holding parts 22*b*, which hold the ends of the two lead wires 40 in the Y direction.

The first holding parts 22*a* take the form of rectangular grooves, the width of these grooves, in the Y direction, being configured so as to be slightly less than the outer diameter of the lead wires 40. Furthermore, the depth of the grooves in the Z direction is configured so as to be slightly greater than the outer diameter of the lead wires 40.

The second holding parts 22*b* have a guide groove 22*b*3 provided adjacent to the first holding part 22*a* and a laterally opening lead-out groove 22*b*4 provided at the end of the guide groove 22*b*3.

The width of the guide groove 22*b*3 in the X direction is slightly less than the outer diameter of the lead wire 40, and the width of the lead-out groove 22*b*4 in the X direction is approximately the same as the outer diameter of the conductor 41 of the lead wire 40. Accordingly, a stepped part 22*b*5 is formed between the guide groove 22*b*3 and the lead-out groove 22*b*4. The inner peripheral side of the intersection between the first holding part 22*a* and the second holding part 22*b* is arcuately curved.

The ends of the lead wires 40 are pushed into the second holding part 22*b* and the portions near the ends of the lead wires 40 are pushed into the first holding parts 22*a*, whereby the two lead wires 40 are held by the lead wire holding part 22. Furthermore, the leading end faces 42*a* of the insulating covering of the two lead wires 40 are positioned by abutting against the stepped parts 22*b*5. Furthermore, the conductors 41 at the leading ends of the two lead wires 40 are each respectively led out in the Y direction of the lead wire holding part 22 through the two lead-out grooves 22*b*4.

With the present example, an effect similar to that in the first exemplary mode of embodiment is produced. In addition, in the antenna device of the present example, since the lead wire holding part 22 only has grooves that open upward, it is easy to form the holder 20.

Three exemplary modes of embodiment of the present invention were described above, but the present invention is not limited to these exemplary modes of embodiment, and it is a matter of course that the exemplary modes of embodiment described above can be suitably modified or the like, within a range that does not depart from the gist of the present invention.

Specifically, there are no particular limitations on the format for the core holding part 21, so long as it can hold the magnetic-material core when the coil is wound. Furthermore, for example, if Ni—Zn ferrite or the like, which has high resistivity, is used as the magnetic-material core, the coil can be wound directly on the magnetic-material core, and therefore the core holding part 21 may be constituted only by a concave housing part that houses only one end of the magnetic-material core, in the X direction, where the coil is not wound, and binding parts where the coil is bound may be provided on the outer surface of this housing part.

Furthermore, as long as they can securely hold the lead wires, the grooves in the first holding part 22*a* and the second holding part 22*b* of the lead wire holding part 22 are not limited to those having a rectangular cross section but rather, for example, may also be U-shaped or trapezoidal.

Furthermore, in the exemplary modes of embodiment described above, a case in which the antenna device is mounted on the door handle of a vehicle were described, but the antenna device of the present invention can also be applied to doors in homes, offices and the like.

What is claimed is:

1. An antenna device in which an antenna coil is housed in a tubular case, wherein:

the antenna coil has a rectangular parallelepiped magnetic-material core elongated in an X direction, a holder made from resin, which is fitted on the magnetic-material core, a coil, which is wound around an outer periphery of the magnetic-material core, and two lead wires, which are electrically connected to two ends respectively of the coil and are led out to an exterior of the case;

the holder has a core holding part, which holds the magnetic-material core and a lead wire holding part, which holds the lead wires;

each one of the lead wires has a conductor and an insulating covering, which covers the conductor;

the lead wire holding part has two first holding parts, which hold respectively a first end of each one of the two lead wires in the X direction, and two second holding parts, which hold respectively the respective first ends of the lead wires in a Y direction; and the two ends of the coil are directly connected, respectively, to the respective conductors, which are led out via the two second holding parts.

2. The antenna device according to claim 1, wherein:

each one of the two second holding parts has a through-hole;

an inner diameter of the respective through-hole is greater than an outer diameter of the respective conductor and less than an outer diameter of the respective insulating covering;

the conductors are led out via the respective through-holes; and a leading end face of the respective insulating covering is positioned on a proximal side of the respective through-hole.

3. The antenna device according to claim 1, wherein:

each one of the two second holding parts has a lead-out groove, which leads the respective conductor out, and a stepped part adjacent to the lead-out groove; and a leading end of the respective insulating covering is positioned by the respective stepped part.

4. The antenna device according to claim 1, wherein:

the two second holding parts, which hold the two lead wires, are provided at different positions in the X direction.

5. The antenna device according to claim 1, wherein:

the core holding part has first covering parts, which cover two sides of the magnetic-material core that face each other in the X direction, and second covering parts, which cover two sides of the magnetic-material core that face each other in the Y direction; and the core holding part is open in the Z direction.

6. The antenna device according to claim 5, wherein binding parts, on which the ends of the coil are bound, are provided on the outer surfaces of the second covering parts.

7. The antenna device according to claim 5, wherein the first covering part and the second covering part have restraining projections, which restrain the movement of the magnetic-material core in the Z direction.

8. The antenna device according to claim 1, wherein:

the core holding part has a housing part, which houses one end, in the X direction, of the magnetic-material core; and a binding part, on which an end of the coil is bound, is provided on an outer surface of the housing part.

9. An antenna device in which an antenna coil is housed in a tubular case, wherein:

the antenna coil has a rectangular parallelepiped magnetic-material core elongated in an X direction, a holder made from resin, which is fitted on the magnetic-material core, a coil, which is wound around an outer periphery of the magnetic-material core, and two lead wires, which are electrically connected to two ends respectively of the coil and are led out to an exterior of the case;

the holder has a core holding part, which holds the magnetic-material core and a lead wire holding part, which holds the lead wires;

each one of the lead wires has a conductor and an insulating covering, which covers the conductor;

the lead wire holding part has two first holding parts, which hold respectively a first end of each one of the two lead wires in the X direction, and two second holding parts, which hold respectively the respective first ends of the lead wires in a Y direction;

the two ends of the coil are directly connected, respectively, to the respective conductors, which are led out via the two second holding parts;

each one of the two second holding parts has a through-hole;

an inner diameter of the respective through-hole is greater than an outer diameter of the respective conductor and less than an outer diameter of the respective insulating covering;

the conductors are led out via the respective through-holes;

a leading end face of the respective insulating covering is positioned on a proximal side of the respective through-hole; and the two second holding parts, which hold the two lead wires, are provided at different positions in the X direction.

10. An antenna device in which an antenna coil is housed in a tubular case, wherein:

the antenna coil has a rectangular parallelepiped magnetic-material core elongated in an X direction, a holder made from resin, which is fitted on the magnetic-material core, a coil, which is wound around an outer periphery of the magnetic-material core, and two lead wires, which are electrically connected to two ends respectively of the coil and are led out to an exterior of the case;

the holder has a core holding part, which holds the magnetic-material core and a lead wire holding part, which holds the lead wires;

each one of the lead wires has a conductor and an insulating covering, which covers the conductor;

the lead wire holding part has two first holding parts, which hold respectively a first end of each one of the two lead wires in the X direction, and two second holding parts, which hold respectively the respective first ends of the lead wires in a Y direction; the two ends of the coil are directly connected, respectively, to the respective conductors, which are led out via the two second holding parts;

each one of the two second holding parts has a lead-out groove, which leads the respective conductor out, and a stepped part adjacent to the lead-out groove;

a leading end of the respective insulating covering is positioned by the respective stepped part; and the two second holding parts, which hold the two lead wires, are provided at different positions in the X direction.

* * * * *